US005453110A

United States Patent [19]

Yu et al.

[11] Patent Number: 5,453,110

[45] Date of Patent: Sep. 26, 1995

[54] METHOD OF GAS FLUXING WITH TWO ROTATABLE DISPENSERS

[75] Inventors: Ho Yu, Murrysville, Pa.; Michael Scherbak, Knoxville, Tenn.

[73] Assignee: Aluminum Company of America, Pittsburgh, Pa.

[21] Appl. No.: 378,421

[22] Filed: Jan. 26, 1995

[51] Int. Cl.[6] ..... C22B 21/06

[52] U.S. Cl. ..... 75/681; 75/708

[58] Field of Search ..... 75/680, 681, 682, 75/708

[56] References Cited

U.S. PATENT DOCUMENTS 5,342,429 8/1994 Yu et al. ..... 75/680

*Primary Examiner*—Melvyn Andrews
*Attorney, Agent, or Firm*—Elroy Strickland

[57] ABSTRACT

A method of gas fluxing molten aluminum with at least two, relatively small diameter upper and lower rotatable dispersers located in the molten aluminum and mounted on a shaft. Fluxing gas is added to the molten aluminum beneath each of the rotatable dispersers at a substantial rate of gas flow while rotating the dispersers at a substantial rpm in the molten aluminum. The dispersers directly shear gas bubbles that form in the molten aluminum as the fluxing gas is directed into the molten aluminum beneath each of the dispersers. The direct shearing of the gas bubbles maintains a high surface area between the bubbles and molten aluminum to effect efficient removal of impurities in the molten aluminum.

4 Claims, 1 Drawing Sheet

METHOD OF GAS FLUXING WITH TWO ROTATABLE DISPENSERS

BACKGROUND OF THE INVENTION

The present invention relates generally to fluxing practices that remove impurities from molten aluminum, and particularly to the use of at least two mechanical stirrers and the addition of fluxing gas introduced into the molten aluminum beneath each of the mechanical stirrers.

U.S. Pat. No. 5,342,429 to Ho Yu et al, which issued Aug. 30, 1994, discusses the problems with impurities in molten aluminum, such impurities including oxide particles, dissolved gas and chemical impurities such as calcium, sodium, magnesium and lithium. The disclosure of this patent is fully incorporated herein by reference. Mr. Yu is one of the inventors of the present disclosure and application.

Standard processes for fluxing molten aluminum generally employ fluxing gas rates of 0.005 to 0.05 SCFH (standard cubic feet per hour) per pound of metal using a single impeller having a twelve-inch diameter, such as shown in U.S. Pat. No. 3,839,019 to Bruno et al. The rate of rotation of the impeller is at a relatively low rpm, i.e., about 200 rpm. In the case of the above incorporated Yu et al patent, purging gas is introduced into a body of molten aluminum on the order of 0.005 SCFH per pound of aluminum beneath the lowermost of two rotors mounted on a single shaft.

SUMMARY OF THE INVENTION

The invention is directed to downsizing a vessel or box containing a body of molten aluminum, and increasing substantially the efficiency of the process of removing impurities from molten aluminum. This is accomplished by using multiple disperser rotors and multiple feeds of fluxing gas into the molten aluminum beneath each of the rotors. For example, the invention uses six-inch diameter rotors (mounted on a hollow shaft) in place of the standard twelve-inch diameter rotors. The rotors are rotated in the range of 400 to 900 rpm, depending upon the size of the fluxing system and the impurities to be removed. A fluxing gas rate of 170 to 250 SCFH is employed, with a typical gas flow being on the order of 0.43 SCFH of gas per pound of metal. Such a gas loading is 50% greater than the processes of the prior art. The "50%" here is in comparison to the disclosure of the above U.S. Pat. No. 5,342,429 (80 to 200 SCFH) and is about eight times that of dispersed gas loading per pound of metal of the prior art, i.e., eight times the above 0.05 SCFH per pound of metal.

THE DRAWINGS

Figure 1:
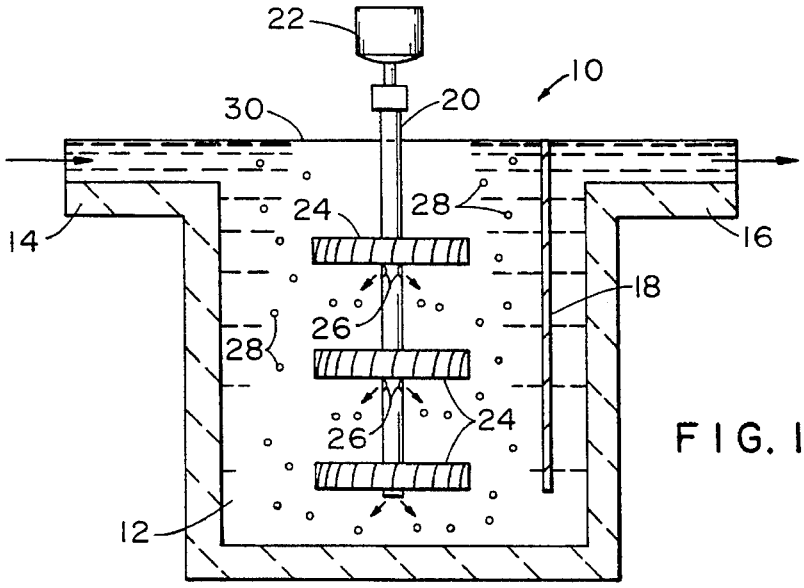
Figure 2:
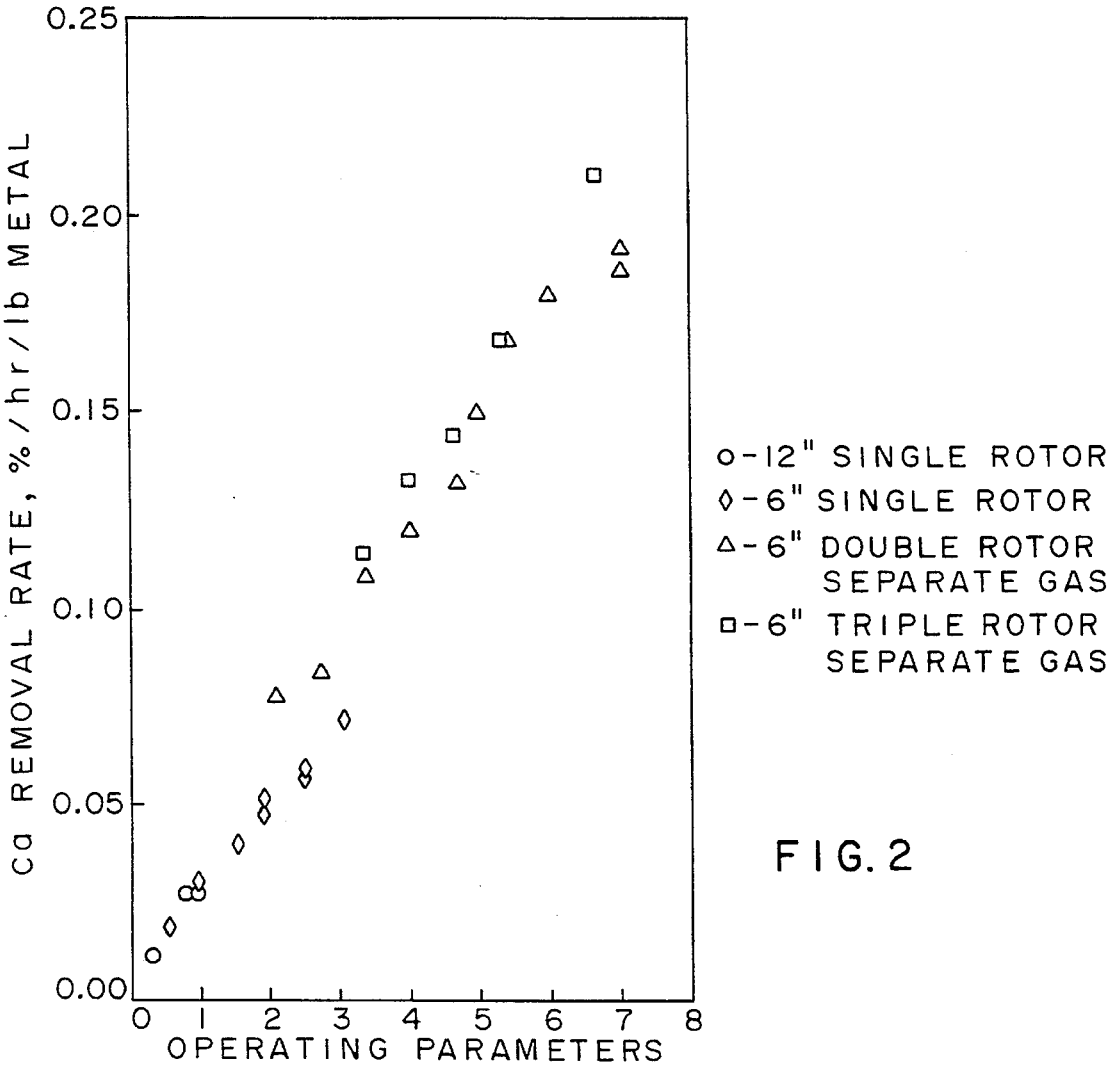

The invention, along with its advantages and objectives, will be better understood from consideration of the following detailed description and the accompanying drawings in which:

FIG. 1 is a diagrammatic representation of a three-rotor fluxing system for removing impurities from a body of molten metal, and FIG. 2 is a chart that compares single rotor and multiple rotor systems in regard to calcium removal rate from a body of molten aluminum.

PREFERRED EMBODIMENT

Referring now to the drawings, FIG. 1 thereof shows schematically a process box and vessel 10 containing molten aluminum 12. The vessel comprises a system for purifying the aluminum, which enters the vessel through a conduit or pipe 14 and exits the vessel via an outlet 16. Before exiting the vessel, the molten metal travels beneath a baffle 18 to reduce the amount of oxide, salt particles and fluxing gas entering the exit stream. Gas bubbles generally rise and substantially leave the metal bath before exiting the box.

Extending vertically into vessel 10 is a shaft 20 suitably connected to a motor 22 for rotating the shaft and a plurality (three in FIG. 1) of impellers 24 mounted and vertically displaced on the shaft. Preferably the shaft is hollow for conducting a fluxing gas, such as chlorine and/or a nonreactive gas selected from the group consisting of argon and nitrogen or mixtures thereof, into the vessel and thus into the molten aluminum. The gas can enter shaft 20 above motor 22 from a source of the gas (not shown) or enter a coupling 25 that permits stationary input to the shaft while the shaft itself rotates.

Openings 26 are provided in shaft 20 immediately beneath the upper two impellers in FIG. 1 for directing the fluxing gases from the hollow shaft and into the molten aluminum. Fluxing gas is directed from the lower end of the shaft and thus beneath the lowermost impeller, which lower end is open. Gas bubbles 28 form beneath the impellers and rise toward the upper surface of the molten metal, as seen in FIG. 1.

The flow of gas through openings 26 and the lower end of shaft 20 is self-regulating. The back pressure of the molten metal is the highest in the lowermost regions of the molten metal such that gas enters the molten metal more readily from the uppermost opening(s) in the shaft. The next capability of gas admission to the molten metal is the next intermediate opening(s) in the shaft. The amount of gas leaving the lower end of the shaft will be somewhat less than that of the intermediate opening(s) assuming the amount of gas entering the shaft from the gas source is sufficient to supply all exits of the shaft.

Shaft openings 26 and the lower open end of shaft 20 allow a substantial flow of gas into the molten metal such that the efficiency of the fluxing system of the invention is substantially improved over the disclosure of above U.S. Pat. No. 5,342,429. This will be discussed below in terms of the data presented in FIG. 2 of the drawings. This efficiency has permitted downsizing of the box 10 (containing the molten metal) including reducing in half the diameters of the impeller, such that six-inch diameter impellers (24) can be used and can be rotated by motor 22 at a substantial rpm, up to 900 rpm, for example. In addition, since gas bubbles 28 form in the molten metal beneath each rotating impeller and rise past the edges of the rotating impellers, the impellers directly shear the gas bubbles. The shearing of the bubbles reduces their tendency to coalesce, as they rise, such that the number of small size bubbles remains large to provide large surface areas for contacting impurities in the molten metal, such as dissolved hydrogen, inclusions and elements such as calcium, sodium, magnesium and lithium. The contact with impurities strips the molten metal of the impurities, i.e., dissolved gases combine with the fluxing gases and rise to the surface of the molten metal and escape from the vessel with the fluxing gases. The vessel has a lid (not shown) equipped with an exhaust to allow the gas to leave. The gases, in addition, strip unwanted elements and particulates from the molten metal by reacting with reactive gas, e.g.

chlorine, to form salt, which are then removed from the vessel as skim on the surface of the bath or as a vapor which escapes through the exhaust.

The fluxing gas enters the molten metal at a high rate, i.e., on the order of 250 SCFH for the three impeller disperser system of FIG. 1, such that the gas loading provided by the present invention is about fifty percent greater than the prior practices of about 170 SCFH. A typical flow rate per pound of molten metal for the gas is 0.43 SCFH, which is eight times the 0.05 SCFH of current practices. Such a rate, in combination with six-inch diameter impellers 24 rotating at the rpm's of the FIG. 2 chart provided the high removal rates of calcium from a body of molten aluminum, in comparison to the single, twelve-inch diameter impeller of the prior art. The removal rate of calcium in FIG. 2 is expressed in terms of percent of calcium per hour (hr) per pound (lb) of metal. As shown, the removal rates effected by the double and triple high speed, small diameter impellers or dispersers far exceeded the capabilities of the single (both six- and twelve-inch diameter) impellers or dispersers tested.

Certain operating parameters of the fluxing process were employed to correlate data presented in FIG. 2. These are listed as follows:

rotor rpm impeller or disperser diameter mass of the metal in box 10 gas flow rate into the box, and upper surface area 30 of the metal bath.

Because dispersers 24 have a relatively small diameter, the high speed of rotation of the rotors does not generate substantial turbulence in the body of molten metal 12 such that undue splashing of the metal in box 10 does not occur. This reduces the tendency of the metal to acquire oxygen and water vapor from the atmosphere within the box and the resulting formation of aluminum oxide and hydrogen gas impurities.

While the invention has been described in terms of preferred embodiments, the claims appended hereto are intended to encompass all embodiments which fall within the spirit of the invention.

What is claimed is:

1. A method of gas fluxing molten aluminum in a relatively compact container, said aluminum containing impurities, comprising:

adding fluxing gas to said molten aluminum at locations directly beneath each disperser of a plurality of relatively small diameter dispersers located one above the other in said molten aluminum, said fluxing gas comprising a reactive or halogenous and/or a nonreactive gas selected from the group consisting of argon gas, nitrogen gas, or mixtures thereof, said fluxing gas being added beneath each of said dispersers at a rate in substantial excess of 0.05 SCFH of gas per pound of aluminum, said fluxing gas when entering the molten aluminum beneath each disperser providing an initial interfacial area between the gas and the molten aluminum, and rotating the plurality of small diameter dispersers at a substantial rpm, directly shearing bubbles of the gas that form in the molten aluminum beneath the dispersers to create a substantial interfacial area between the fluxing gas and molten aluminum, using said substantial interfacial area to remove impurities from the molten aluminum.

2. The method of claim 1 in which the rate of gas flow into the molten aluminum lies in the range of 170 to 250 SCFH.

3. The method of claim 1 in which the dispersers are rotated in the range of 400 to 900 rpm.

4. A method of gas fluxing molten aluminum containing impurities in a relatively compact container, said method comprising:

providing a body of molten aluminum, locating a gas dispersing unit in the body of molten aluminum, said unit having a plurality of relatively small diameter impellers mounted on a common, relatively small diameter shaft extending into said body of molten aluminum, rotating said unit at a substantial rpm, simultaneously with said rotation, adding a fluxing gas directly beneath each impeller at a rate in substantial excess of 0.05 SCFH of gas per pound of molten aluminum, said fluxing gas comprising a reactive or halogenous and/or a nonreactive gas selected from the group consisting of argon, nitrogen or mixtures thereof, using said impellers to directly shear gas bubbles that form in the molten aluminum beneath each impeller when the fluxing gas is added to provide finely divided bubbles in the molten aluminum without substantial splashing of the molten aluminum, and redispersing coalesced fluxing gas bubbles with said impellers as the fluxing gas rises toward the surface of the body of molten aluminum.

* * * * *